US008251264B2

(12) United States Patent
Guillo et al.

(10) Patent No.: US 8,251,264 B2
(45) Date of Patent: Aug. 28, 2012

(54) CONTINUOUS CASTING TUNDISH

(75) Inventors: Philippe Guillo, Paris (FR); Dominique Janssen, Mc Kees Rocks, PA (US); José Simoes, Saint-Ghislain (BE)

(73) Assignee: Vesuvius Crucible Company, Wilmington, DE (US)

( * ) Notice: Subject to any disclaimer, the term of this patent is extended or adjusted under 35 U.S.C. 154(b) by 474 days.

(21) Appl. No.: 11/995,443

(22) PCT Filed: Jul. 14, 2006

(86) PCT No.: PCT/EP2006/006899
§ 371 (c)(1),
(2), (4) Date: Jan. 11, 2008

(87) PCT Pub. No.: WO2007/009667
PCT Pub. Date: Jan. 25, 2007

(65) Prior Publication Data

US 2008/0210719 A1 Sep. 4, 2008

(30) Foreign Application Priority Data

Jul. 15, 2005 (EP) ..... 05076628

(51) Int. Cl.
*B22D 41/50* (2006.01)

(52) U.S. Cl. ..... 222/590; 222/591

(58) Field of Classification Search ..... 222/590, 222/591, 594; 266/236, 283, 286
See application file for complete search history.

(56) References Cited

FOREIGN PATENT DOCUMENTS

JP 09 220650 8/1997
JP 2003 205360 A 7/2003

*Primary Examiner* — Jessica L Ward
*Assistant Examiner* — Alexander Polyansky
(74) *Attorney, Agent, or Firm* — Thomas Clinton; Donald M. Satina

(57) ABSTRACT

A tundish assembly, including an element, for preventing or limiting steel reoxidization in the continuous casting of molten steel, is used in combination with a refractory nozzle. The element has an orifice engaging the outer surface of the nozzle, a main surface surrounding the main orifice and having a lowest level lower than the top outer edge of the nozzle inlet portion, and a periphery having an upper face surrounding the man surface of the element. The upper face of the periphery of the element is higher than the main surface of the element and is higher than the surface of the bottom well of the tundish. The main surface of the element is arranged so as to contact molten steel when the tundish is in use.

4 Claims, 3 Drawing Sheets

CONTINUOUS CASTING TUNDISH

BACKGROUND OF THE INVENTION (1) Field of the Invention

The present invention relates to the continuous casting of steel and particularly to the problem of steel reoxidation. In particular, the invention relates to a tundish comprising an assembly comprising a nozzle and a surrounding refractory element preventing or limiting steel reoxidation. According to other of its aspects, the invention also relates to such a surrounding refractory element and to a continuous steel casting process.

With growing demands for quality and property control, cleanliness of steel becomes more and more important. Issues like controlling the chemical composition and the homogeneity have been supplanted by concerns generated by the presence of non-metallic inclusions. Especially the presence of aluminium oxide inclusions is considered as harmful both for the production process itself as for the steel properties. These inclusions are mainly formed during the deoxidation of the steel in the ladle, which is necessary for continuous casting. Incomplete removal of the non-metallic inclusions during secondary metallurgy and reoxidation of the steel melt cause nozzle clogging during continuous casting. The layer of clogged material contains generally large clusters of aluminium oxide. Its thickness is related to the amount of steel cast as well as to the cleanliness of the steel. Nozzle clogging results in a decreased productivity, because less steel can be cast per unit of time (as result of the decreasing diameter) and due to replacement of nozzles with concurrent casting interruptions. Besides clogging, the presence of reoxidation products may give rise to erosion of the nozzle and to the formation of inclusion defects in the steel.

(2) Description of Related Art

Several solutions have been developed in the art to prevent steel reoxidation. In particular, the molten metal stream is generally shrouded with a pouring shroud during its transfer from a casting vessel to a downstream vessel (or mold) to prevent direct contact between the poured steel and the surrounding atmosphere. Argon is often injected directly at the surface of a pouring nozzle so as to shield the molten metal stream. The surface of the steel melt in a metallurgical vessel (for example a tundish) is generally covered with a liquid slag layer so as to prevent direct contact between the steel and the surrounding atmosphere. Alternatively (or in addition), the atmosphere above the tundish can be made inert (use of oxygen scavenger or of inert gas such as argon).

Further solutions have been developed in the art to remove non-metallic inclusions and reoxidation products when they are present in the tundish. These solutions consist generally in facilitating the floatation of these inclusions and reoxidation products so that these are captured by the floating slag layer. For example, dams, weirs, baffles and/or impact pads can be used to deflect upwardly the molten metal stream in the tundish. Inert gas bubbling device can also be used to float out inclusions and reoxidation products.

Other solutions also exist for making the inclusions and oxidation product harmless. For example calcium based alloys can be used to eliminate some of the problems generated by the presence of aluminum oxide inclusions.

All these prior art solutions have contributed to improve the general cleanliness of the steel but have not yet permitted the casting of inclusion- or reoxidation products-free steel. Moreover, some of the prior art solutions can, in turn, generate new defects in the steel (such as gas bubbling, calcium-based alloy), can be expensive (use of inert atmosphere) or environmentally unacceptable. For these reasons, it would be desirable to propose an alternative solution which would solve the above problem, which would be economical and would not raise environmental problems.

BRIEF SUMMARY OF THE INVENTION

The present invention is based on the hypothesis that, even though the steel can be made relatively clean, it is impossible to keep it clean up to the mold in normal conditions. In particular, reoxidation of the steel by chemical reaction between the refractory elements (generally metal oxide) used in the continuous casting (vessel lining, slag, nozzles, stoppers, etc.) can also generate reoxidation products. Another potential source of reoxidation is the oxygen permeating through these refractory elements or through a permeable joint between the bottom wall lining and the nozzle inlet or even the oxygen desorbed from the refractory element.

An object of the present invention is therefore to solve the above problems by preventing the reoxidation products from reaching a casting nozzle and/or from forming in the immediate vicinity of or in the casting nozzle.

According to the invention, this object is achieved by the use of a tundish according to claim 1.

It is already known in the art to provide a surrounding element around the pouring orifice of a tundish. FR-A-2394348 for example discloses a ring intended to retain the steel in the tundish until a sufficient level and thereby a sufficient thermal mass is reached in order to avoid the entry of "cold" steel into the pouring orifice. The prior art however fails to disclose the lowest level of the main surface of the surrounding element or ring to be lower than the top outer edge of the nozzle.

JP-A1-2003-205360 discloses a tundish for the continuous casting of steel. The well block of this tundish is comprised of two elements. The nozzle is located inside the bottom part of the well block. An additional refractory element is positioned above the upper part of the nozzle to cover and protect the cement joint between the nozzle and the well block. However, this document fails to disclose that the outer periphery of the refractory element must be higher than the surface of the bottom wall of the tundish.

Thanks to the particular arrangement according to the present invention, the reoxidation products and/or inclusions present in the metallurgical vessel and which tend to accumulate on the bottom surface of the vessel and are carried down by the molten steel stream cannot reach the inlet of the nozzle.

It must be understood that the element surrounding the nozzle can be of any appropriate shape. In function of the metallurgical vessel design; it can be circular, oval or polygonal; its main orifice can be central or eccentric. The element surrounding the nozzle can also be cut off so as to accommodate those cases when one or more tundish walls are close to the pouring orifice. The main surface of the element can be planar or not (it can be frusto-conical, rippled, inclined). The nozzle can be an inner nozzle (for example in case the molten steel flow is controlled with a slide gate valve or if the installation is equipped with a tube or calibrated nozzle changer) or a submerged entry shroud or SES (for example in the case of stopper control). The metallurgical vessel or tundish can be equipped with one or more of such assemblies. The assembly can be supplied as a one-piece pre-assembled article (for example co-pressed or cast around) or as separated articles.

According to the present invention, the refractory element comprises a main surface and a periphery surrounding the main surface; the upper face of the periphery being higher than the main surface of the refractory element. Thereby, a kind of deflecting trap is created in the area surrounding the nozzle. It must be understood that the upper face of the periphery does not need to be planar. It can be waved or have different heights along the periphery (for example higher in area of the periphery close to a vessel lateral wall and lower on the other side). The level of the outer periphery of at least one of the refractory element is higher than the surface of the bottom wall of the tundish. Thereby, a second obstacle is created around the nozzle tundish preventing the inclusions or reoxidation products from reaching its inlet. This type of arrangement is particularly advantageous.

Advantageously, the surrounding refractory element is made from a gas-impervious material, preferably a castable material. To be regarded as gas-impervious, such material has an open porosity (at the temperature of use) which is lower than 20% (thus lower than the open porosity of conventional lining material which is typically higher than 30%). For refractory materials and in particular castable materials, the permeability is generally directly related to the porosity. Therefore a low porosity castable has a low permeability to gases. Such a low porosity can be obtained by including oxygen scavenger materials (e.g. antioxidants) in the material constituting the surrounding element. Suitable materials are boron or silicon carbide, or metals (or alloys thereof) such as silicon or aluminum. Preferably, they are used in an amount not exceeding 5 wt %. Alternatively (or in addition), products generating melting phase (for example $B_2O_3$) can also be included in the material constituting the surrounding element. Preferably, they are used in an amount not exceeding 5 wt. %. Alternatively or (in addition), materials forming more voluminous new phases (either upon reaction or the effect of the temperature) and closing thereby the existing porosity can also be included in the material constituting the preformed element. Suitable materials include compositions of alumina and magnesia. Thereby, steel re-oxidation in the area surrounding the nozzle is prevented.

According to a particularly preferred embodiment of the invention, the nozzle or (a layer thereof) itself is made from a gas-impervious material. Generally, this nozzle is made from refractory oxides (alumina, magnesia, calcia) and is isostatically pressed. To be regarded as gas-impervious in the sense of the present invention, a 100 g sample of the candidate material is placed in a furnace under argon atmosphere (a gentle stream of argon is continuously blown (about 11/min) into the furnace) and the temperature is raised to 1000° C. The temperature is then raised progressively to 1500° C. (in 1 hour) and is then left at 1500° C. for 2 hours. The loss of weight of the sample between 1000° C. and 1500° C. is then measured. This loss of weight must be lower than 2% for qualifying the material as gas-impervious. Thereby, not only the inclusion or reoxidation products cannot reach the nozzle but, in addition, they cannot form in the nozzle itself. This particular combination provides thus a synergistic effect according to which a perfectly inclusion- and reoxidation product-free steel can be cast.

The material constituting the nozzle can be selected from three different categories of materials:

a) materials which do not contain carbon;

b) materials essentially constituted of non reducible refractory oxides in combination with carbon; or c) materials comprising elements which will react with the generated carbon monoxide.

Preferably, the selected material will present two or three of the above categories.

Examples of suitable material of the first category are alumina, mullite, zirconia or magnesia based material (spinel).

Suitable materials of the second category are for example pure alumina carbon compositions. In particular, these compositions should contain very low amounts of silica or of conventional impurities which are usually found in silica (sodium or potassium oxide). In particular, the silica and its conventional impurities should be kept under 1.0 wt. %, preferably under 0.5 wt. %.

Suitable materials of the third category comprise for example free metal able to combine with carbon monoxide to form a metal oxide and free carbon. Silicon and aluminum are suitable for this application. These materials can also or alternatively comprise carbides or nitrides able to react with oxygen compound (for example silicon or boron carbides).

Preferably the selected material will belong to the second or third categories, even preferably, it will belong to the second and third category.

A suitable material constituting the layer which will not produce carbon monoxide at the temperature of use can comprise 60 to 88 wt. % of alumina, 10 to 20 wt. % graphite and 2 to 10 wt. % of silicon carbide. Such a material is essentially constituted of non-oxide species or non-reducible oxides and comprises silicon carbide which can react with the oxygen if some is present in working conditions.

In a variant, only a liner present at the steel contacting surface (inside and outside of the nozzle) is made from such a material. In another variant, the nozzle and the surrounding element are made integral (one-piece).

In case the joint between the surrounding element and the nozzle is not perfectly tight, it might be advantageous to provide a mortar joint which is made from a gas impervious mortar. Conventional mortars have an open porosity of 40 to 50%. According to this advantageous embodiment, the mortar should have an open porosity of less than 20%. Such a low porosity of the mortar can be obtained by adopting the same measures as for the surrounding element.

According to another of its aspects, the invention relates to a particular surrounding refractory element which is used in the assembly according to the invention. This surrounding element comprises a main orifice adapted for matching engagement with at least a portion of the outer surface of the nozzle, a main surface surrounding the main orifice and an outer periphery surrounding the main surface, the level of the upper face of the periphery being higher than that of the main surface. Advantageously, the surrounding refractory element is made from a gas-impervious material. Thereby, steel reoxidation in the area surrounding the nozzle is prevented. For example, a particularly suitable composition to this end is essentially comprised of a high alumina material comprising at least 75 wt. % of $Al_2O_3$, less than 1.0 wt. % of $SiO_2$, less than 5 wt. % of C, the reminder being constituted of refractory oxides or oxides compounds that cannot be reduced by aluminum (particularly aluminum dissolved in molten iron) at the temperature of use (for example calcia and/or spinel. A particularly suitable material is the CRITERION 92SR castable available from VESUVIUS UK Ltd. This material is a high alumina low cement castable material reinforced with fused alumina-magnesia spinel. A typical analysis of this product is the following:

| | |
|---|---|
| $Al_2O_3$ | 92.7 wt. % |
| MgO | 5.0 wt. % |

-continued

| | |
|---|---|
| CaO | 1.8 wt. % |
| $SiO_2$ | 0.1 wt. % |
| Other | 0.4 wt. % |

According to yet another of its aspects, the invention is directed to a process for the continuous casting of steel which comprises pouring the molten steel from a tundish as above described.

BRIEF DESCRIPTION OF THE SEVERAL VIEWS OF THE DRAWINGS

The invention will now be described with reference to the attached drawings in which.

DETAILED DESCRIPTION OF THE INVENTION

Figure 1:
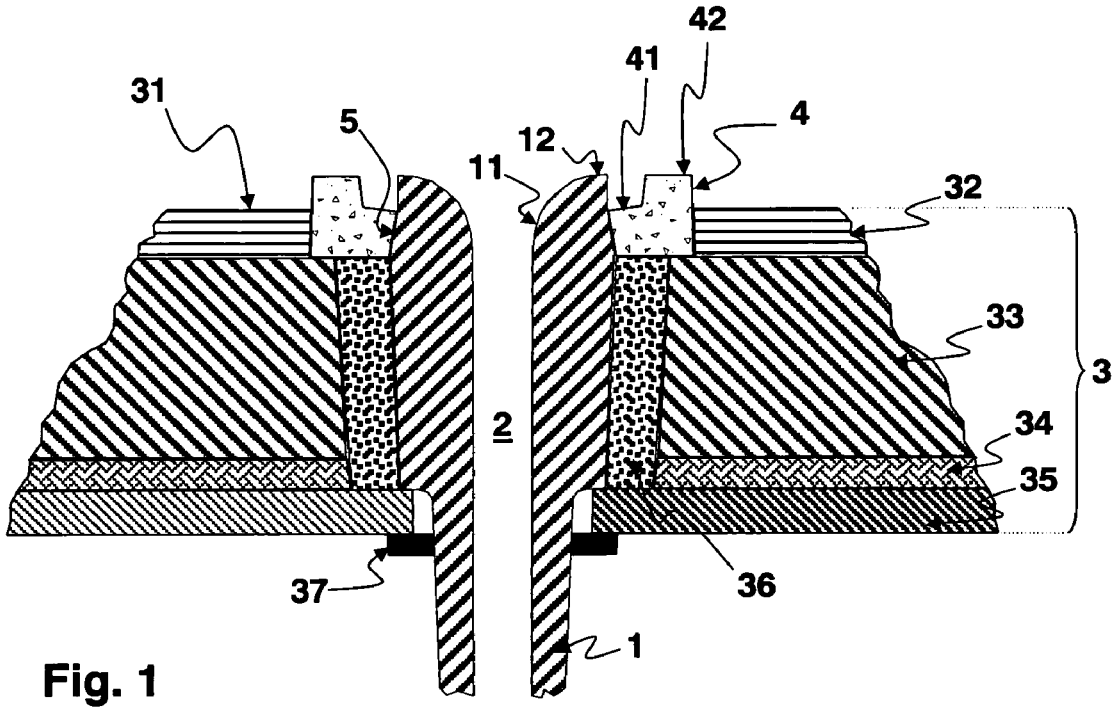
FIG. 1 shows a cross-section of the bottom wall of a metallurgical vessel provided with an assembly according to the invention.

The bottom wall 3 of a metallurgical vessel (here a tundish) is generally constituted of a permanent lining 33 made from refractory bricks or castable material. A working layer 32 of castable material is generally present above the permanent lining 33. The upper surface 31 of the working layer will contact molten steel during the casting operations. A layer of insulating material 34 is normally present under the permanent lining 33 in order to protect the metallic envelope 35 of the metallurgical vessel.

A nozzle 1 goes through the bottom of the tundish and serves to the transfer of the molten steel from the tundish to the continuous casting mold. The nozzle is provided with an inlet 11 opening into a bore defining thus a passage 2 for the molten steel. The upper edge of the inlet is depicted as reference 12. FIG. 1 shows a submerged entry shroud or SES but, as explained above other kinds of nozzles (such as an inner nozzle) are also encompassed within the scope of the present invention. In the case of a SES, the continuous casting operation is generally provided with a guillotine 37 to break the nozzle 1 and allow the continuation of the casting operations in case of clogging. Generally, the SES is maintained in position by a ramming mass 36.

Figure 2:
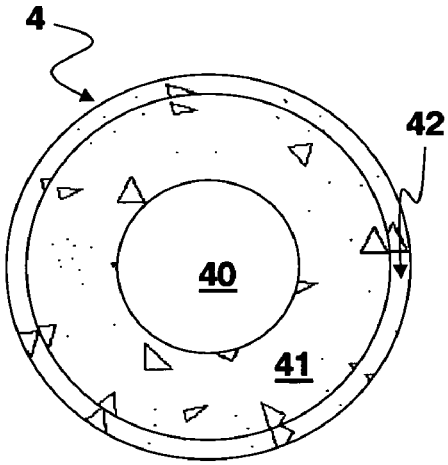
FIGS. 2 and 3 show respectively top and perspective views of a surrounding element according to the invention.
Figure 3:
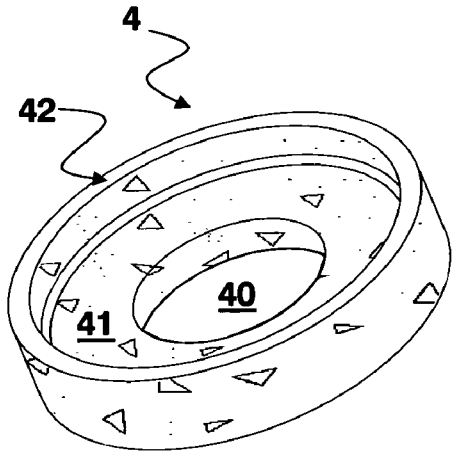

The surrounding refractory element 4 surrounds the inlet portion 11 of the nozzle 1. The surrounding element 4 is comprised of a main surface 41 surrounding a main orifice 40. The main surface has been represented as exposed and frustoconical at FIG. 1 and exposed and planar at FIGS. 2 and 3, but, as explained above, other arrangements are possible. A raised outer periphery surrounds the main surface 41. The upper face 42 of the periphery is higher than the level of the main surface 41.

As can be seen on FIG. 1, it is advantageous to have the upper face 42 of the periphery rising higher than the surface 31 of the tundish.

A mortar or cement joint at the junction 5 between the refractory element 4 and the nozzle 1 can be provided for further tightness improvement.

Figure 4:
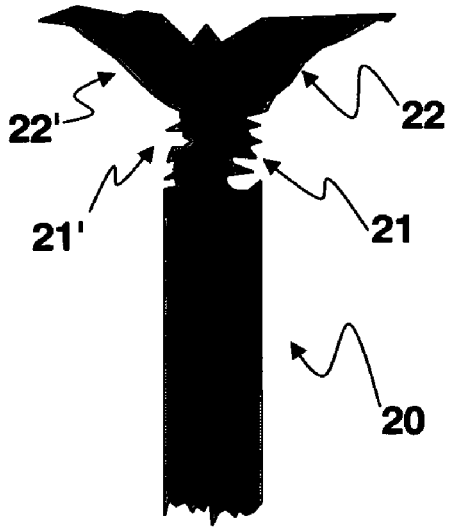
FIGS. 4 and 5 show skulls collected at the end of the casting operations in the upper part of the nozzle.

A trial has been performed to illustrate the effect of the invention. The solidified steel skull remaining in the inner nozzle at the end of casting operations has been collected and cut vertically in the middle. FIG. 4 (given by way of comparison) shows such a skull collected in a conventional installation (without the surrounding refractory element) and FIG. 5 shows such a skull collected in an installation according to the invention.

The skull 20 of FIG. 4 shows significant disturbance in the region 21, 21' indicating the presence of alumina deposit on the inner wall of the nozzle. This alumina deposit is responsible for the clogging of the nozzle with all the detrimental consequences explained above. The skull 20 of FIG. 4 shows also an enlarged portion in the region 22,22' indicating a severe erosion of the nozzle inlet.

Figure 5:
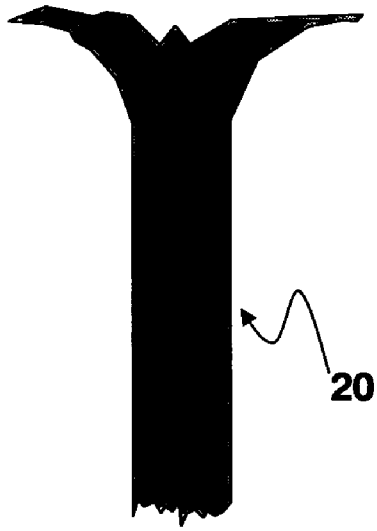

The skull 20 shown on FIG. 5 corresponds to the inner shape of the nozzle indicating thereby that the nozzle has not been subjected to erosion nor to alumina clogging.

Figure 6:
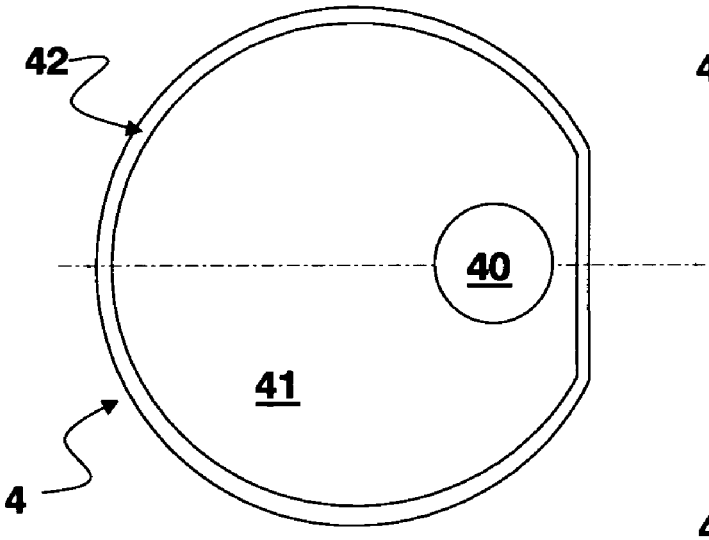
FIGS. 6 and 6*a* show respectively top and side views of a surrounding element according to an embodiment of the invention.
Figure 6A:
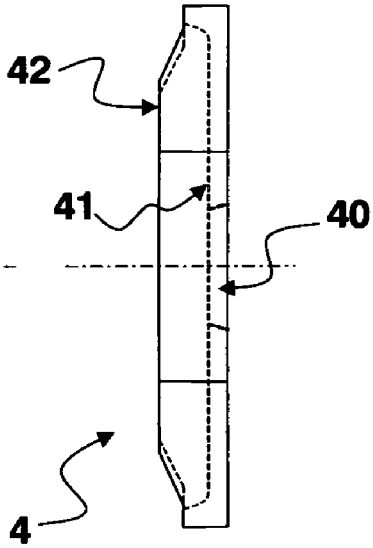
Figure 7:
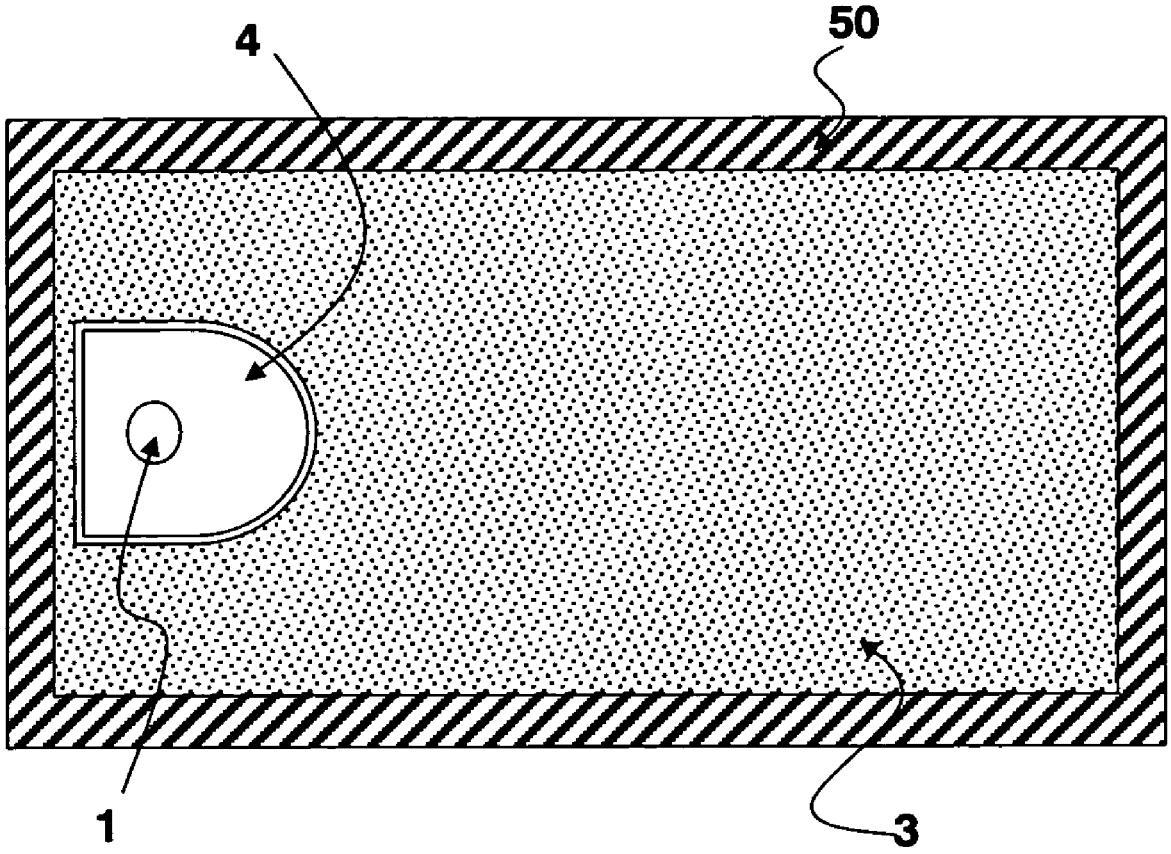
FIG. 7 shows a top view of a tundish according to the invention. The tundish 50 (having a bottom wall 3) comprises a refractory element 4 having a cut off so as to accommodate to the vicinity of the tundish wall. The nozzle 1 is not detailed for the sake of clarity.

A particular embodiment of the invention illustrating a surrounding element 4 provided with a cut off is shown on FIGS. 6, 6*a* and 7.

We claim:

1. Assembly of (a) a tundish for the continuous casting of molten steel and of (b) a refractory nozzle forming a passage for transferring a molten metal through the bottom wall of the tundish, the tundish having a bottom wall having an upper surface, the tundish comprising an element surrounding an inlet portion of the nozzle, the element being made from a refractory material and comprising a main orifice adapted for matching engagement with at least a portion of the outer surface of the nozzle, an exposed main surface of the element surrounding the main orifice and having a lowest level, the lowest level of the main surface of the element being lower than the top outer edge of the nozzle inlet portion, a periphery of the element having an upper face surrounding the main surface of the element, the upper face of the periphery being higher than the main surface of the element, wherein the upper face of the periphery of the element is higher than the upper surface of the bottom wall of the tundish.

2. Assembly according to claim 1, wherein the element is made from a material having an open porosity lower than 20%.

3. Assembly according to claim 1, wherein the nozzle is constituted of a material that loses less than 2% by weight between 1000 and 1500° C. when subjected to a test wherein a 100 g sample of the material is placed in a furnace under argon atmosphere, the temperature is raised to 1000° C., then raised to 1500° C. in 1 hour and left at 1500° C. for 2 hours.

4. Assembly according to claim 1, wherein a mortar joint is present between the nozzle and the element and the mortar forming the mortar joint has an open porosity lower than 20%.

* * * * *